US009398819B2

(12) United States Patent
Tsai et al.

(10) Patent No.: US 9,398,819 B2
(45) Date of Patent: Jul. 26, 2016

(54) BASKET STRUCTURE WITH HOOKS

(71) Applicant: Elfa International AB, Vastervik (SE)

(72) Inventors: Cheng-Yuan Tsai, Taichung (TW); Peter Nilsson, Vastervik (SE)

(73) Assignee: Elfa International AB, Vastervik (SE)

( * ) Notice: Subject to any disclaimer, the term of this patent is extended or adjusted under 35 U.S.C. 154(b) by 0 days.

(21) Appl. No.: 14/512,865

(22) Filed: Oct. 13, 2014

(65) Prior Publication Data

US 2015/0053686 A1 Feb. 26, 2015

(30) Foreign Application Priority Data

Aug. 21, 2014 (TW) ..... 103128884 A

(51) Int. Cl.
*A47F 5/10* (2006.01)

(52) U.S. Cl.
CPC ..... *A47F 5/101* (2013.01)

(58) Field of Classification Search
CPC ..... A47F 5/101; B65D 7/20; B65D 25/22
USPC ..... 220/485, 476, 480, 481, 482, 9.1, 9.4, 220/494, 493, 491
See application file for complete search history.

(56) References Cited

U.S. PATENT DOCUMENTS 3,229,823 A 1/1966 Hummer
8,225,946 B2 * 7/2012 Yang ..... A47B 57/26 108/108
D739,681 S * 9/2015 Bee ..... D7/600.4
2005/0006541 A1 * 1/2005 Magnusson ..... A47B 96/1416 248/235
2005/0269332 A1 * 12/2005 Svabeck ..... A47J 37/1295 220/485
2009/0184077 A1 * 7/2009 Curet ..... A45D 44/04 211/117

FOREIGN PATENT DOCUMENTS

| | | | |
|---|---|---|---|
| CA | 2638487 | A1 | 2/2009 |
| DE | 202005002708 | U1 | 5/2005 |
| EP | 2218355 | A1 | 8/2010 |
| GB | 909033 | A | 10/1962 |
| WO | 2004112541 | A1 | 12/2004 |

OTHER PUBLICATIONS

International Searching Authority / SE, International Search Report, International Patent Application No. PCT/SE2015/050880 Filed Under the Patent Cooperation Treaty, Aug. 19, 2015.

* cited by examiner

*Primary Examiner* — Robert J Hicks
*Assistant Examiner* — Kareen Thomas
(74) *Attorney, Agent, or Firm* — James J. Murphy; Max Ciccarelli; Thompson & Knight LLP

(57) ABSTRACT

A basket may include a basket frame, a hook assembly and a bottom. The basket frame has a meshed unit, and an upper board and lower board extending from the meshed unit. The upper board has a side frame with reversed U shape, and the lower board has an L-shaped portion. The basket frame is made in one piece to avoid soldering, which would decrease the structural strength of the basket. Also, the upper board has a side frame with reversed U shape and the lower board has an L-shaped portion to enhance the structural strength of the basket frame, so the bottom can sustain heavier objects. Furthermore, the basket frame and the bottom are all meshed, the objects are unlikely to fall out from the basket.

9 Claims, 11 Drawing Sheets

BASKET STRUCTURE WITH HOOKS

FIELD OF THE INVENTION

The present invention is related to a basket, and more particularly to a basket structure with hooks.

BACK GROUND OF THE INVENTION

FIG. 11 shows a conventional basket, which includes a basket 50 made by a plurality of U-shaped iron rods 51 arranged with each other and connected with at least two connecting rods 52 through soldering, and a hook unit 53 is soldered on one side thereof. However, the conventional basket is disadvantageous because the iron rods 51 are connected by soldering, which causes inconvenience in the manufacturing process. Also, the structural strength may not be strong enough because the basket is made through soldering. Furthermore, the gap between each iron rods 51 is large, so the objects may fall out from the gap. Therefore, there remains a need for a new and improved basket structure to overcome the problems stated above.

SUMMARY OF THE INVENTION

Conventional basket is disadvantageous because the iron rods are connected by soldering, which causes inconvenience in the manufacturing process. Also, the structural strength may not be strong enough because the basket is made through soldering. Furthermore, the gap between each iron rods is large, so the objects may fall out from the gap.

A basket may include a basket frame, a hook assembly and a bottom. The basket frame has a meshed unit, and an upper board and lower board extending from the meshed unit. The upper board has a side frame with reversed U shape, and the lower board has an L-shaped portion. It is noted that the side frame can be either bended inside or outside, and a protruding unit is disposed on the side frame. The hook assembly is disposed at a predetermined position on the basket frame. The hook assembly has a recessed engaging slot and a hook unit on the surface thereof. A wing extends from both sides of the hook assembly, and is disposed on both ends of the basket frame to connect the basket frame. A reinforced unit is disposed at a bottom portion of the hook assembly, and the reinforced unit and the hook assembly are formed as an L-shaped unit. A reinforced point is formed at the bended portion of the L-shaped unit. It is noted the reinforced unit is a board to connect the L-shaped portion of the basket frame. The bottom is a meshed board corresponding to the L-shaped portion of the basket frame.

The present invention is advantageous because (1) the basket is made in one piece to avoid soldering, which would decrease the structural strength of the basket, and (2) the upper board has a side frame with reversed U shape and the lower board has an L-shaped portion to enhance the structural strength of the basket frame, so the bottom can sustain heavier objects. Also, the basket frame and the bottom are all meshed, the objects are unlikely to fall out from the basket.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
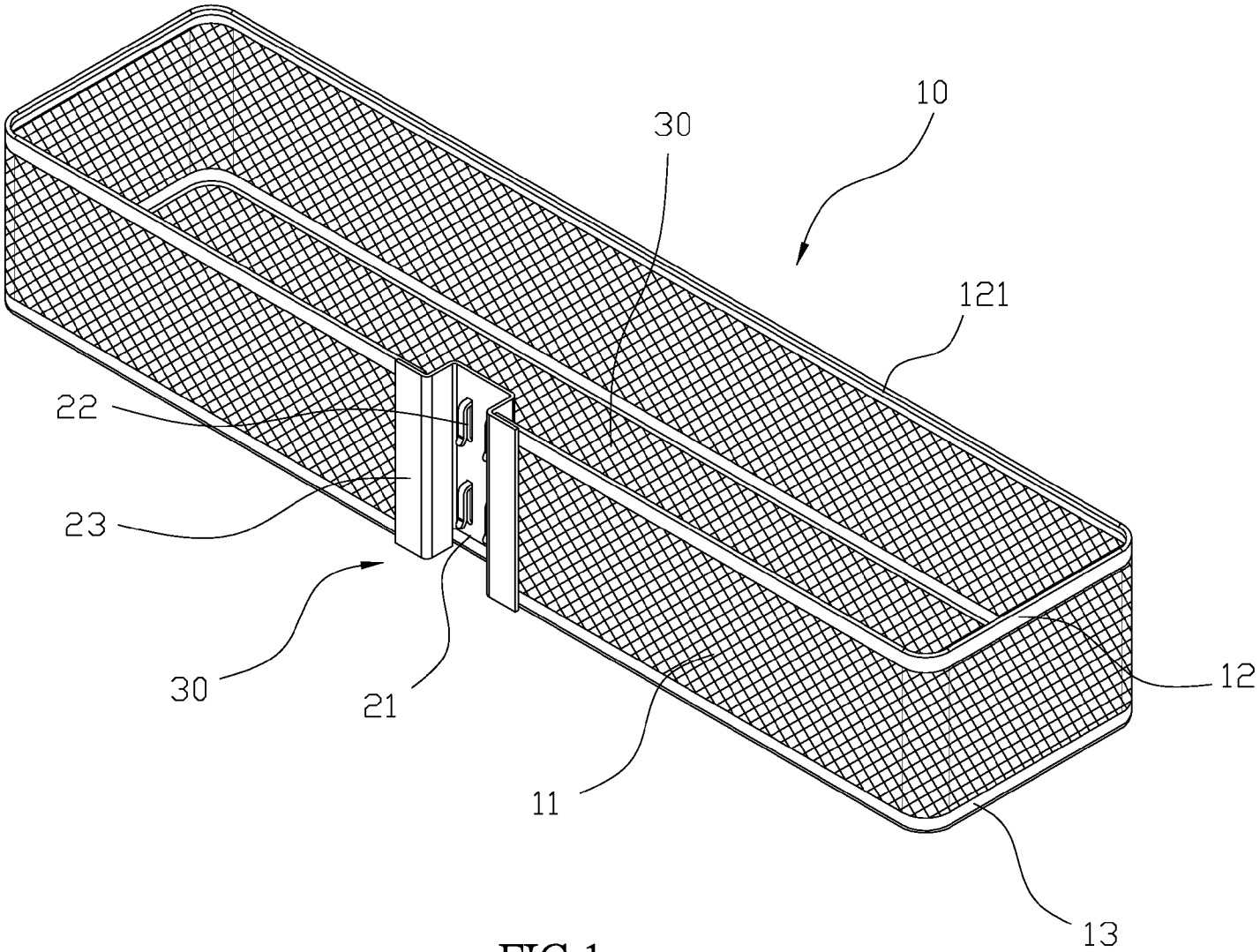
FIG. 1 illustrates a three-dimensional view of the basket in the present invention.
Figure 2:
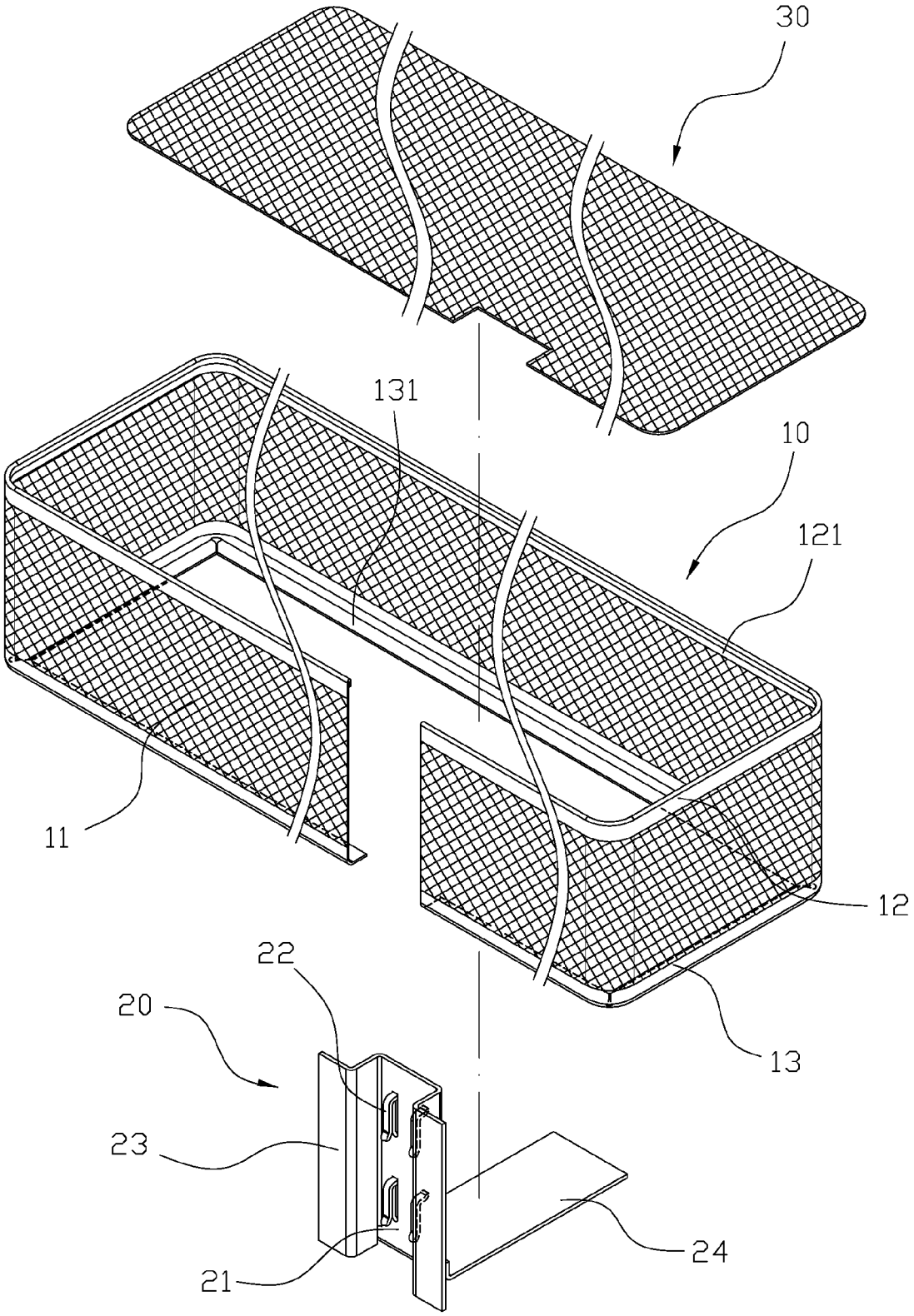
FIG. 2 illustrates an exploded view of the basket in the present invention.
Figure 3:
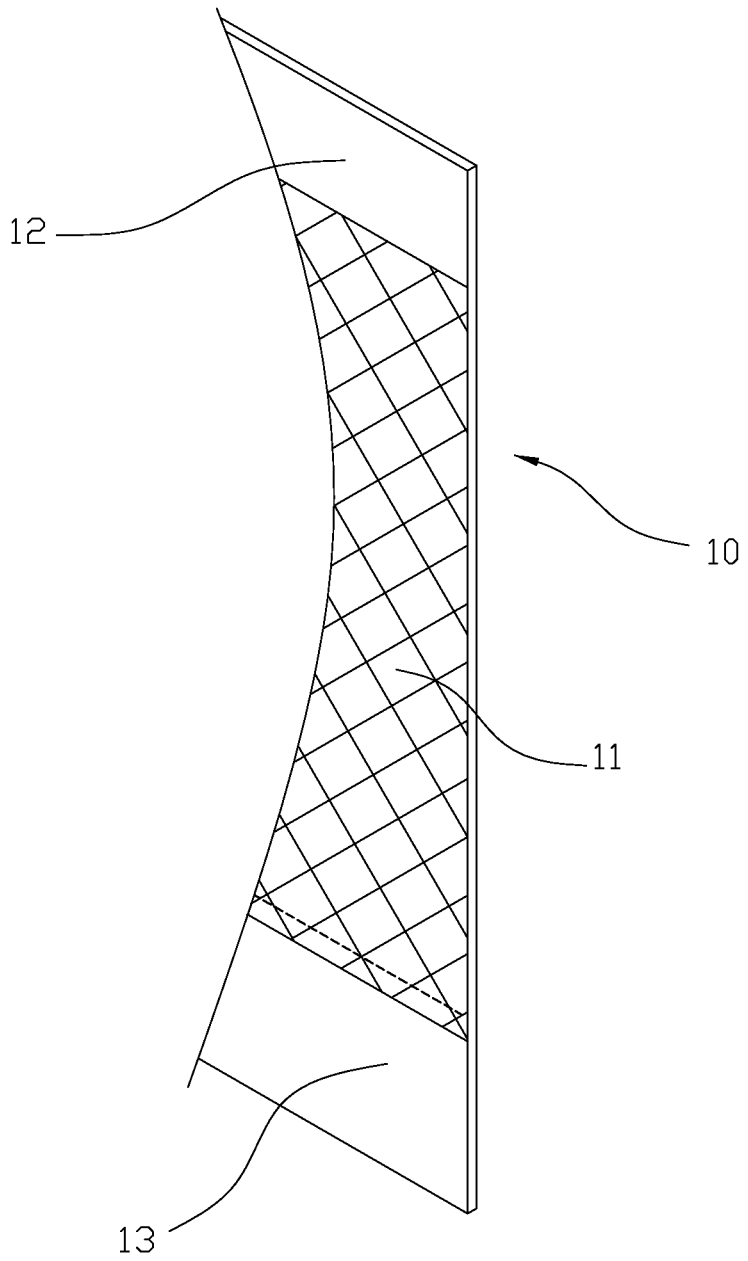
FIG. 3 illustrates a partial enlarged view of the side frame before being bended in the present invention.
Figure 4:
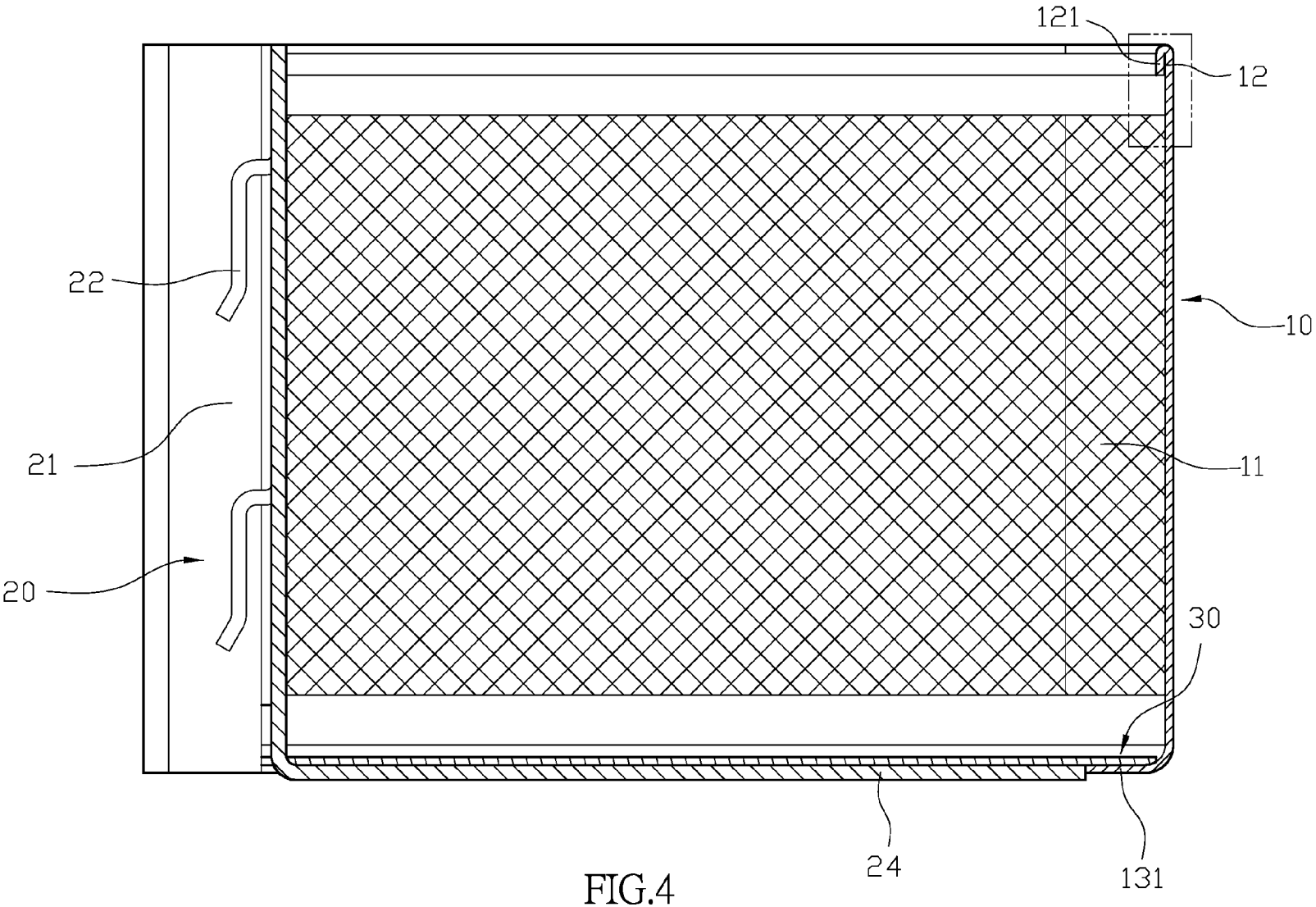
FIG. 4 illustrates a sectional view of the basket in the present invention.
Figure 5:
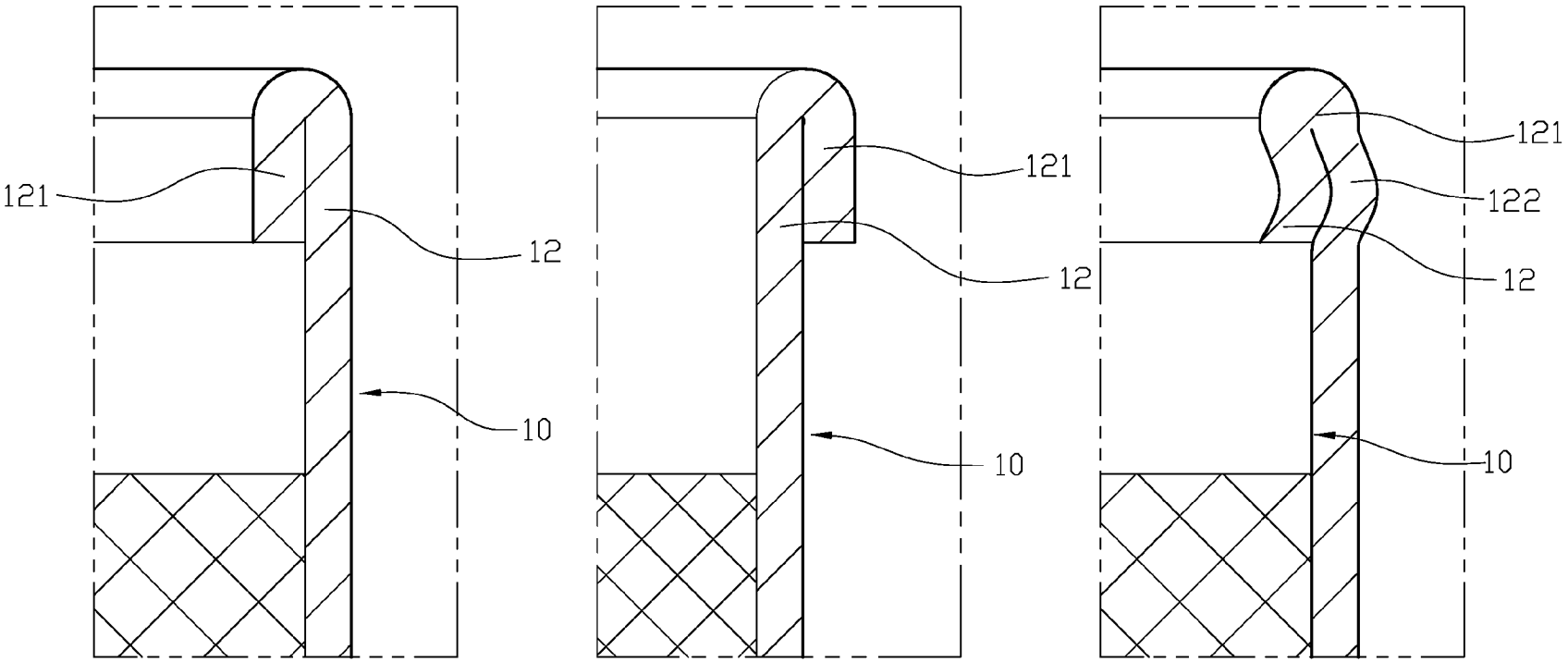
FIG. 5 illustrates a schematic view of the upper board bended inward and outward in the present invention.
Figure 6:
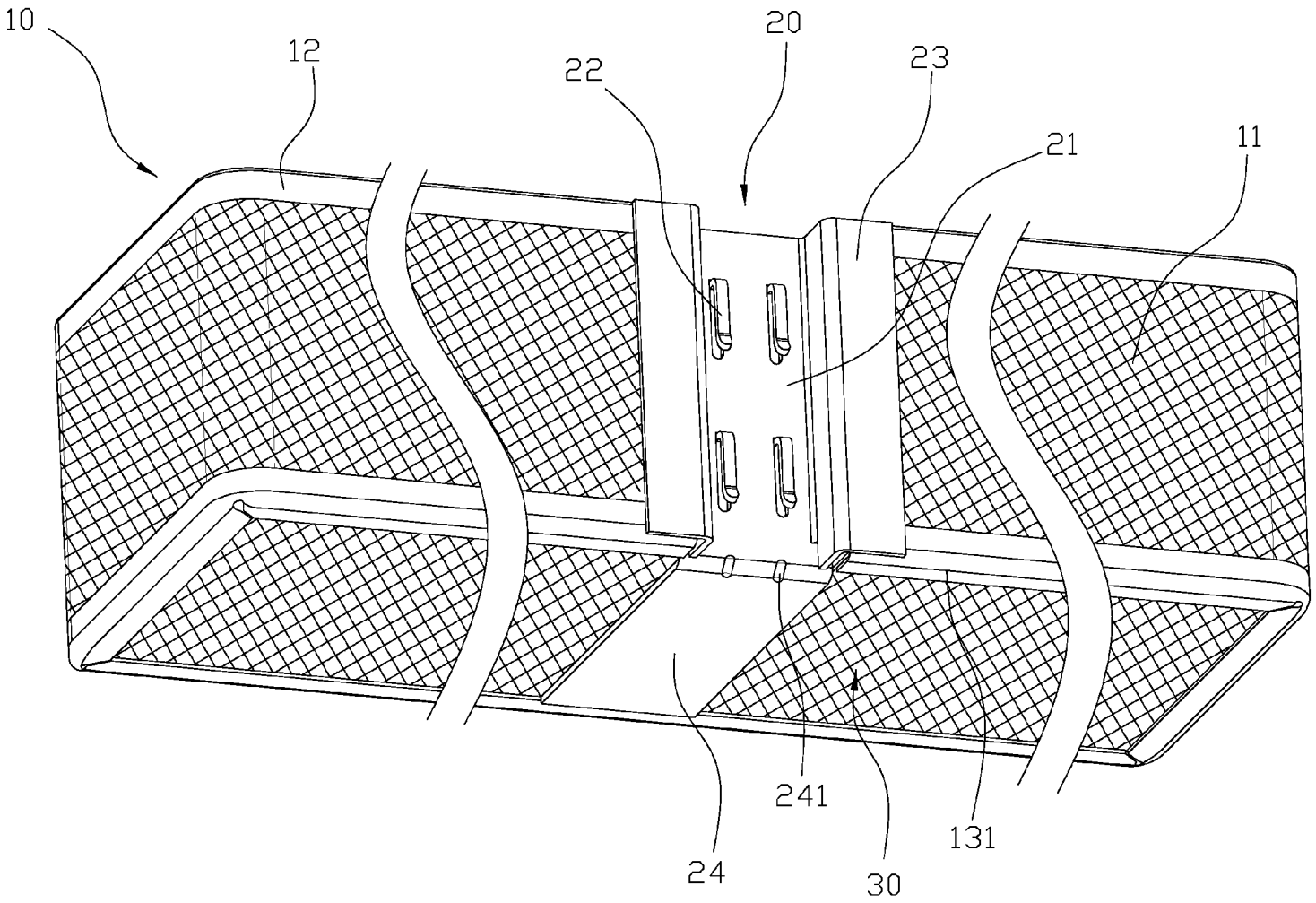
FIG. 6 illustrates a three-dimensional view of the basket in the present invention from another angle.

In order to further understand the goal, characteristics and effect of the present invention, a number of embodiments along with the drawings are illustrated as following:

Referring to FIGS. 1 to 3, a basket may include a basket frame 10, a hook assembly 20 and a bottom 30. The basket frame 10 has a meshed unit 11, and an upper board 12 and lower board 13 extending from the meshed unit 11. The upper board 12 has a side frame 121 with reversed U shape, and the lower board 13 has an L-shaped portion 131. It is noted that the side frame 121 can be either bended inside or outside (see FIGS. 4 and 5), and a protruding unit 122 is disposed on the side frame 121 to increase the structural strength. The hook assembly 20 is disposed at a predetermined position on the basket frame 10. The hook assembly 20 has a recessed engaging slot 21 and a hook unit 22 on the surface thereof. A wing 23 extends from both sides of the hook assembly 20, and is disposed on both ends of the basket frame 10 to connect the basket frame 10. A reinforced unit 24 is disposed at a bottom portion of the hook assembly 20, and the reinforced unit 24 and the hook assembly 20 are formed as an L-shaped unit as shown in FIG. 6. A reinforced point 241 is formed at the bended portion of the L-shaped unit. It is noted the reinforced unit 24 is a board to connect the L-shaped portion 131 of the basket frame 10. The bottom 30 is a meshed board corresponding to the L-shaped portion 131 of the basket frame 10.

Referring to FIGS. 1, 2, 4 and 6, the basket frame 10 can be divided into two bended units, and two ends of the bended units can be provided for the hook assembly 20. More specifically, the wings 23 of the hook assembly are secured at two ends of the basket frame 10. The bottom portion of the hook assembly 20 has a reinforced unit 24 to connect the L-shaped portion 131 of the basket frame 10, so the structural strength of the basket frame 10 can be enhanced by the reinforced unit 24. Finally the bottom 30 is disposed inside the basket frame 10 above the L-shaped portion 131 to complete the assembly process of the basket.

Figure 7:
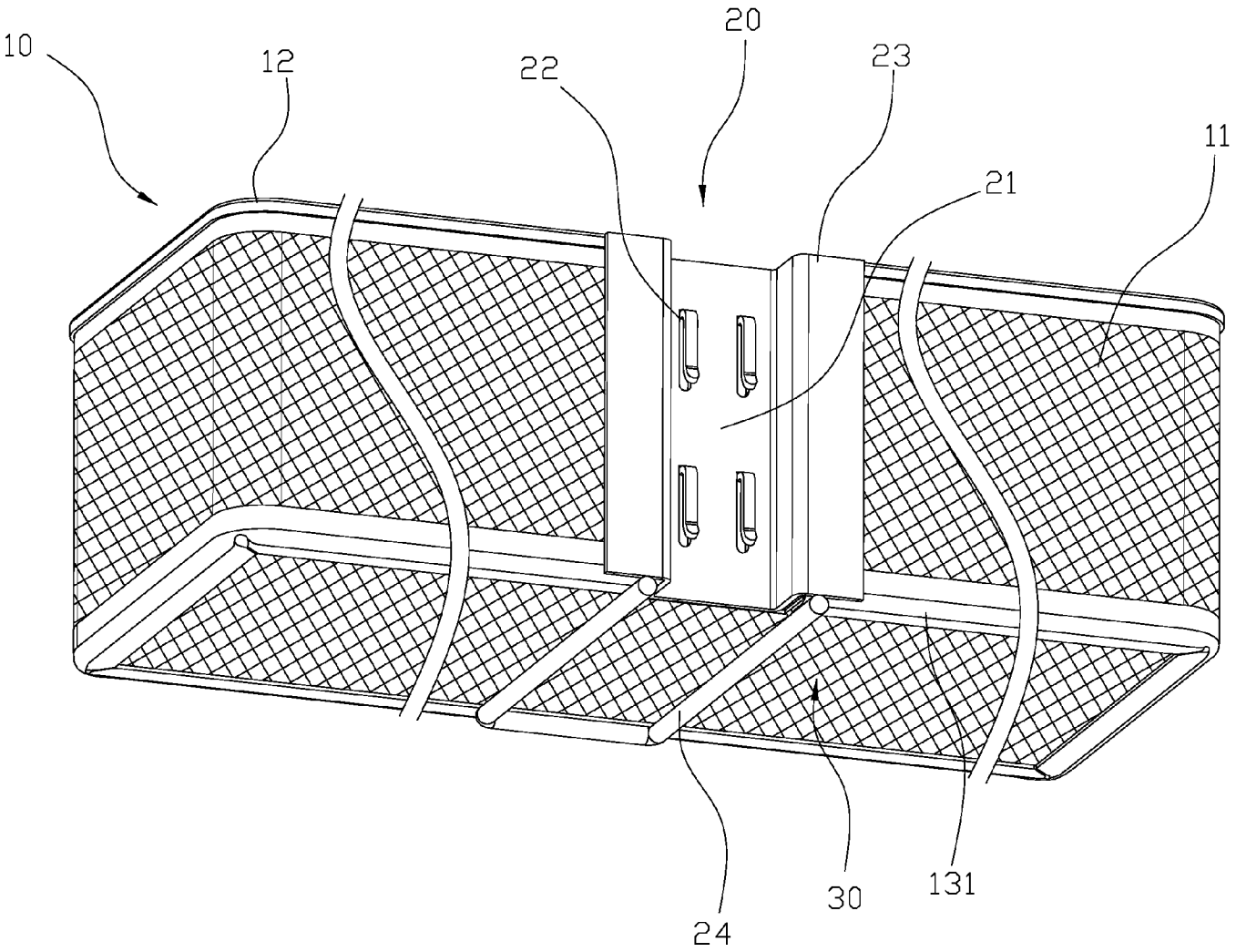
FIG. 7 illustrates another embodiment in the present invention.

In another embodiment, the reinforced unit 24 of the hook assembly 20 is a U-shaped unit to connect the L-shaped unit 131 of the basket frame 10, as shown in FIG. 7.

Figure 8:
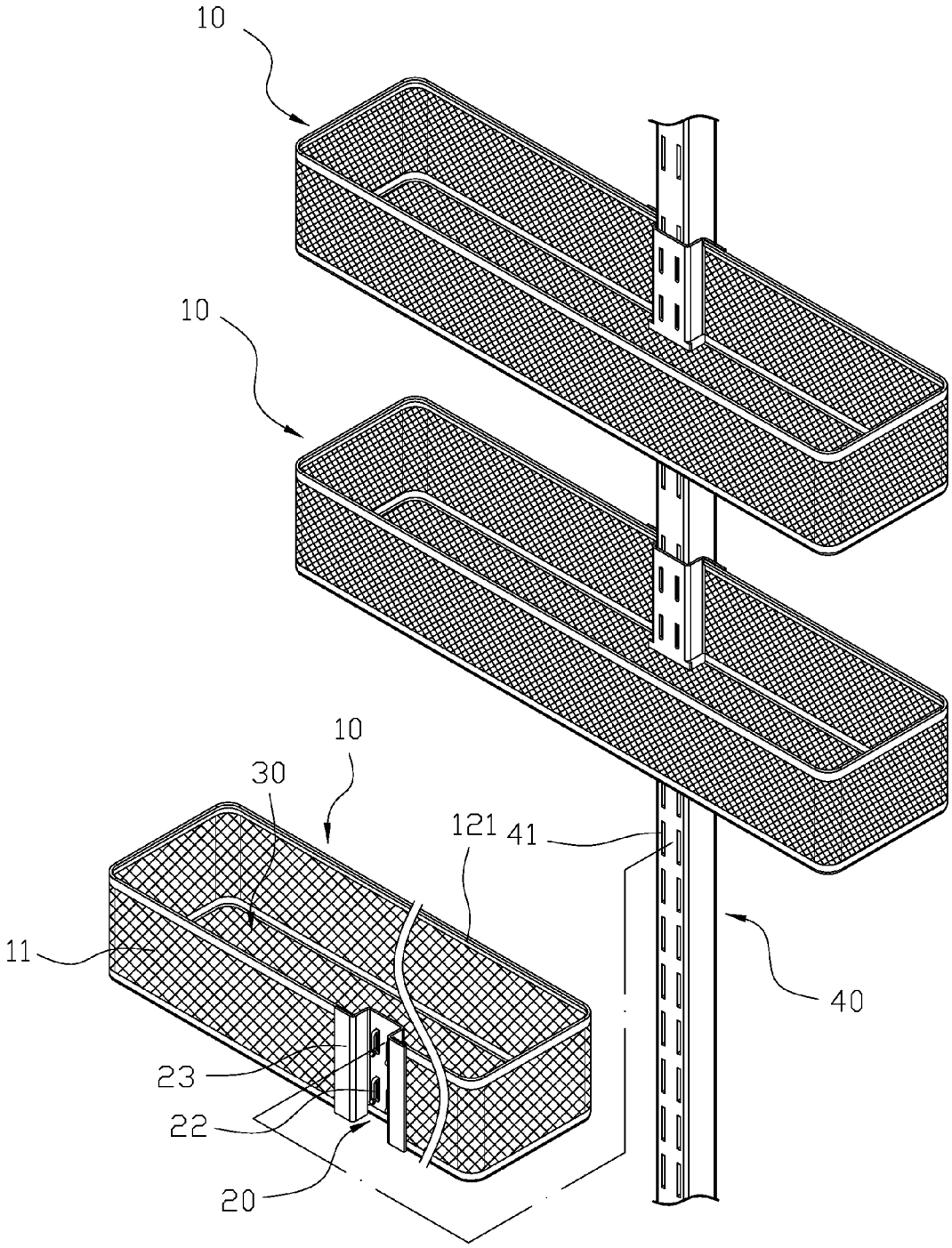
FIG. 8 illustrates a schematic view of the basket in use in the present invention.
Figure 9:
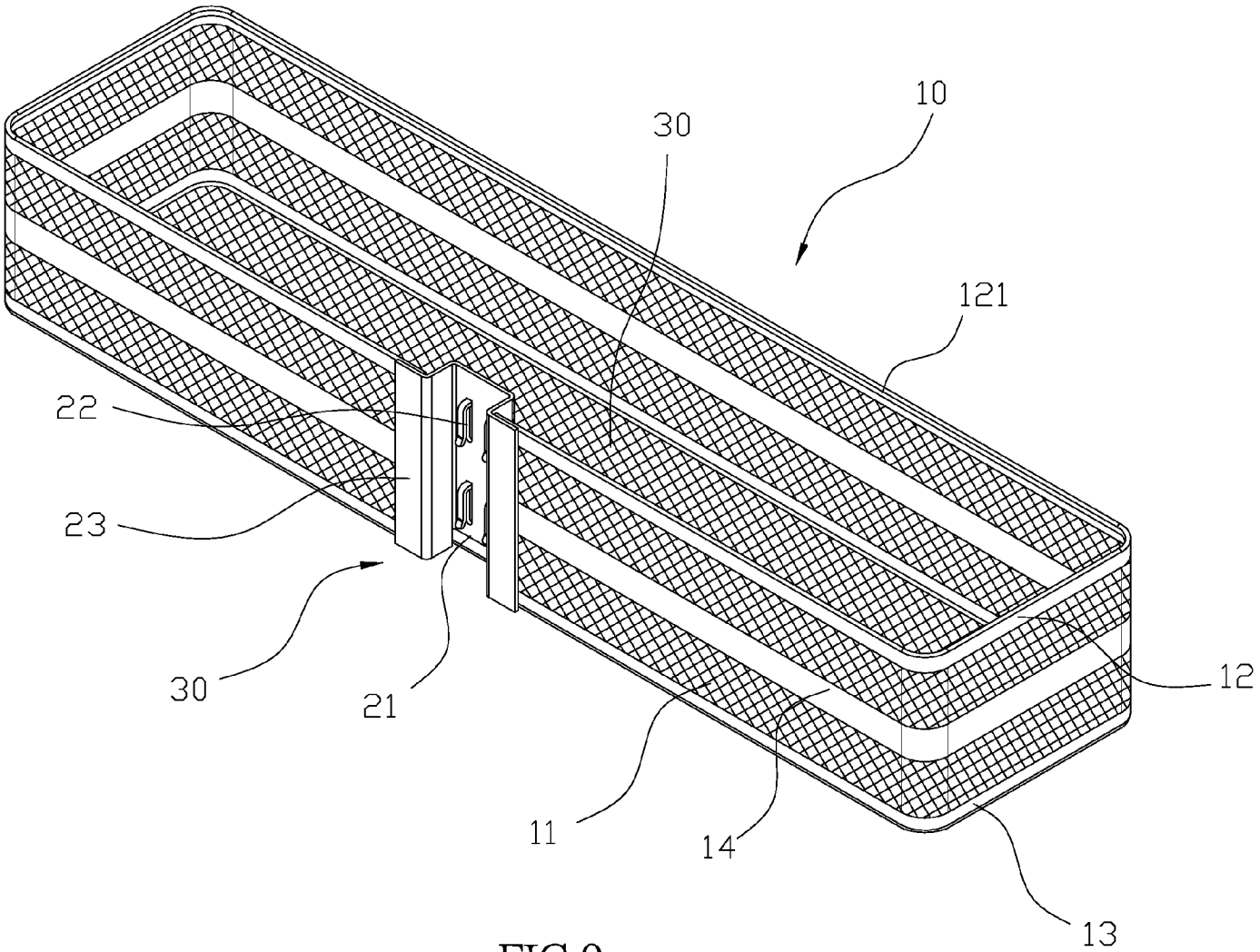
FIG. 9 illustrates a further embodiment in the present invention.
Figure 10:
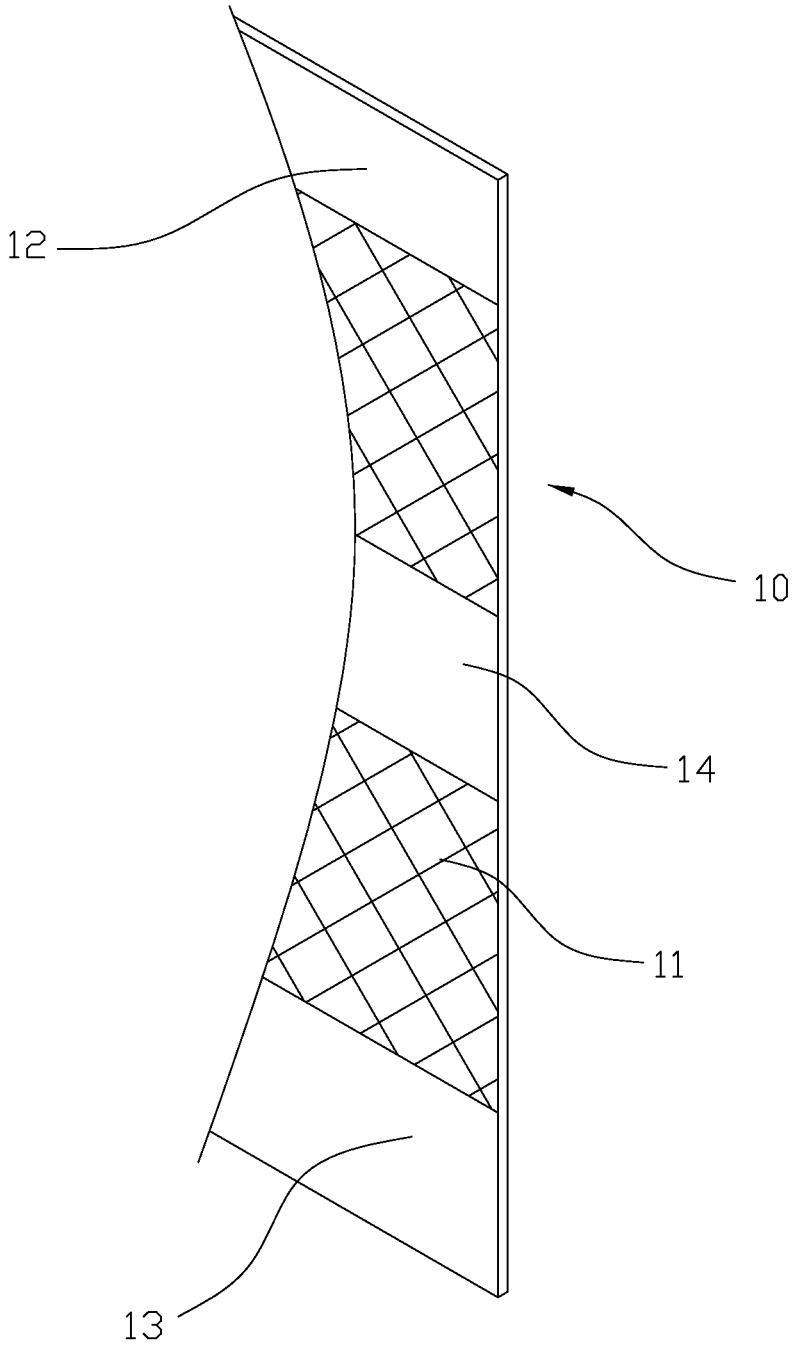
FIG. 10 illustrates a partial enlarged view of the further embodiment in the present invention.
Figure 11:
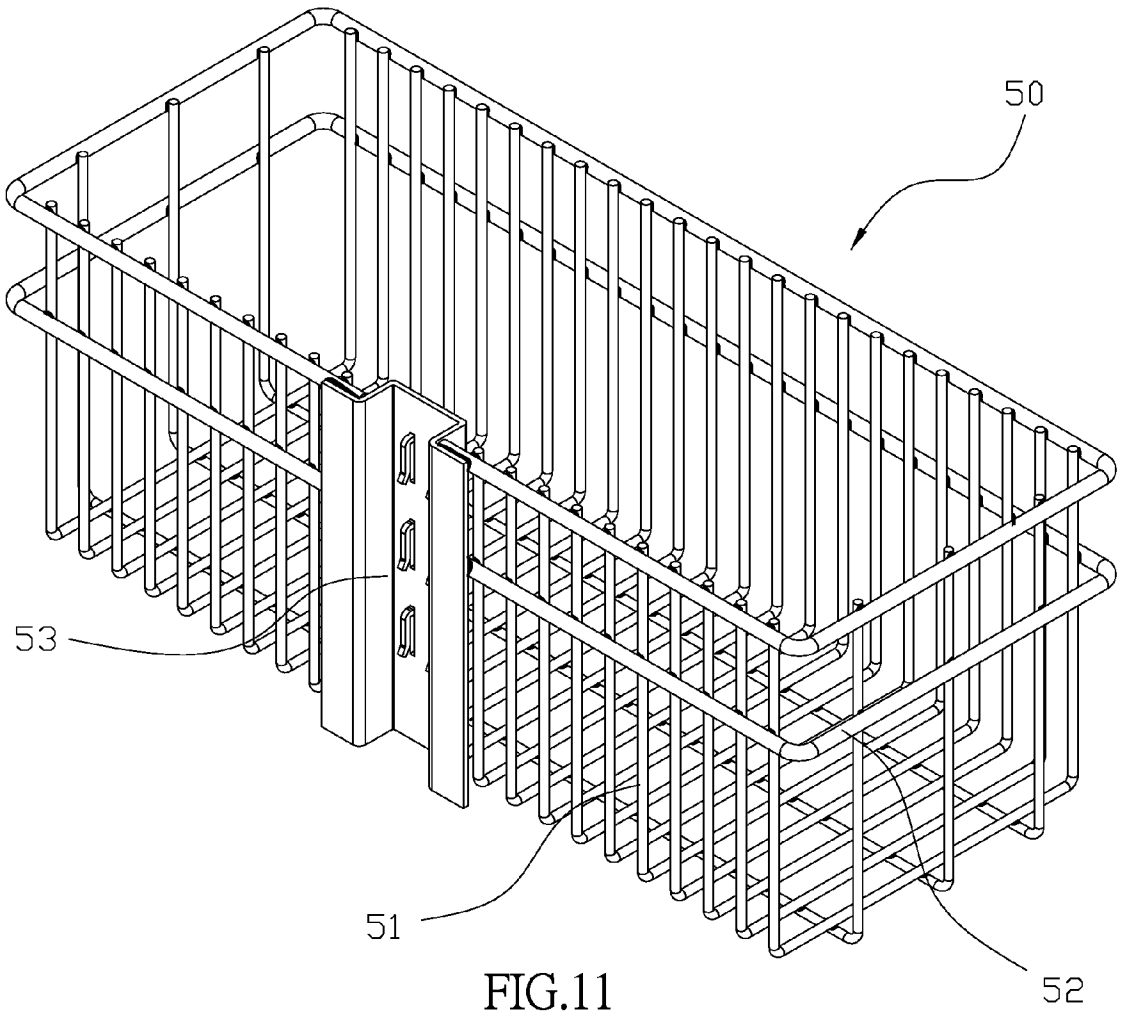
FIG.11 PRIOR ART
FIG. 11 illustrates prior art.

Referring to FIG. 8, the basket can be hung on a rod 40 through the hook assembly 20. More specifically, the basket can be hung on the rod 40 through the hook unit 22 of the hook assembly 20 engaging with engaging holes 41 of the rod 40 to secure the basket. Similarly, the structural strength of the basket frame 10 can be enhanced by the reinforced unit 24.

In a further embodiment, a solid surrounding board 14 is disposed on the meshed unit 11 to enhance the structural strength of the meshed unit 11.

According to the embodiments mentioned above, the present invention is advantageous because (1) the basket frame 10 is made in one piece to avoid soldering, which would decrease the structural strength of the basket, and (2) the upper board 12 has a side frame 121 with reversed U shape and the lower board 13 has an L-shaped portion 131 to enhance the structural strength of the basket frame 10, so the bottom 30 can sustain heavier objects. Also, the basket frame 10 and the bottom 30 are all meshed, the objects are unlikely to fall out from the basket.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A basket comprising:

a basket frame having a meshed unit, and an upper board and lower board extending from the meshed unit, said upper board having a side frame with a reversed U-shape and the lower board having an L-shaped portion;

a hook assembly disposed at a predetermined position on the basket frame and having a reinforced unit disposed at a bottom portion of the hook assembly to secure the L-shaped portion; and a bottom, which is a meshed board corresponding to the L-shaped portion of the basket frame.

2. The basket of claim 1, wherein the side frame is configured to bend inwardly.

3. The basket of claim 1, wherein the side frame is configured to bend outwardly.

4. The basket of claim 1, wherein a protruding unit is disposed on the side frame to increase structural strength.

5. The basket of claim 1, wherein the hook assembly has a recessed engaging slot and a hook unit on a surface thereof, and a wing extends from both sides of the hook assembly, and is disposed on both ends of the basket frame to connect the basket frame.

6. The basket of claim 1, wherein the reinforced unit is a board to connect the L-shaped portion of the basket frame.

7. The basket of claim 6, wherein a reinforced point is formed at a bent portion of the L-shaped unit.

8. The basket of claim 1, wherein the reinforced unit of the hook assembly is a U-shaped unit to connect the L-shaped portion of the basket frame.

9. The basket of claim 1, wherein a solid surrounding board is disposed on the meshed unit to enhance structural strength of the meshed unit.

* * * * *